US011638926B2

(12) United States Patent
Wang

(10) Patent No.: US 11,638,926 B2
(45) Date of Patent: May 2, 2023

(54) ATOMIZATION DEVICE, AROMA DIFFUSION INSTRUMENT, AND OPERATION METHOD

(71) Applicant: Shenzhen One And One Technology Co., Limited, Shenzhen (CN)

(72) Inventor: Weiqin Wang, Shenzhen (CN)

( * ) Notice: Subject to any disclaimer, the term of this patent is extended or adjusted under 35 U.S.C. 154(b) by 0 days.

(21) Appl. No.: 17/569,533

(22) Filed: Jan. 6, 2022

(65) Prior Publication Data

US 2022/0126316 A1 Apr. 28, 2022

(51) Int. Cl.

*B05B 15/55* (2018.01)
*B05B 7/26* (2006.01)
*B05B 15/531* (2018.01)

(52) U.S. Cl.

CPC ..... *B05B 15/55* (2018.02); *B05B 7/267* (2013.01); *B05B 15/531* (2018.02)

(58) Field of Classification Search

CPC ..... B05B 15/55; B05B 15/531; B05B 7/267; A61L 9/14
USPC ..... 293/3; 239/106
See application file for complete search history.

(56) References Cited

U.S. PATENT DOCUMENTS 4,206,160 A * 6/1980 Suddendorf ..... B01F 23/21 261/78.2
4,488,505 A * 12/1984 Schaming ..... B05B 7/2483 118/316
5,224,651 A * 7/1993 Stahl ..... A01M 7/0014 239/102.2
9,308,544 B2 * 4/2016 Ljuhar ..... A61L 9/14
11,344,906 B2 * 5/2022 Liu ..... B05B 17/0676
2010/0084484 A1 * 4/2010 Sevy ..... A61M 11/001 239/340

(Continued)

FOREIGN PATENT DOCUMENTS

EP 0586913 A2 * 11/1993 ..... B01D 53/94
WO WO-2018108584 A1 * 6/2018 ..... A61L 9/12
WO WO-2022029267 A1 * 2/2022 ..... A61L 9/14

OTHER PUBLICATIONS

Machine Translation of WO-2022029267-A1 Description, Espacenet, Mar. 2022, 26 Pages (Year: 2022).*

(Continued)

*Primary Examiner* — Tuongminh N Pham
*Assistant Examiner* — Kevin Edward Schwartz
(74) *Attorney, Agent, or Firm* — Rumit Ranjit Kanakia

(57) ABSTRACT

The present disclosure provides an atomization device, an aroma diffusion instrument, and an operation method. The atomization device includes an atomization chamber, a mixing chamber, a container, a repair cavity, a suction pump, and a gas pump; the atomization chamber is communicated with the mixing chamber through an atomization port; the suction pump is communicated with the container and the mixing chamber; the suction pump is used for pumping a substance in the container to the mixing chamber or pumping a substance in the mixing chamber back to the container; impurities in the mixing chamber can also be discharged from an opening of the repair cavity; the gas pump is connected with the mixing chamber to convey high-pressure gas to the mixing chamber; the high-pressure gas is used for atomizing liquid of the mixing chamber towards the atomization chamber; and the atomization chamber is provided with a mist outlet.

8 Claims, 3 Drawing Sheets

(56) References Cited

U.S. PATENT DOCUMENTS

| | | | | |
|---|---|---|---|---|
| 2011/0280767 | A1* | 11/2011 | Goessens | A61L 9/14 422/106 |
| 2014/0326802 | A1 | 11/2014 | Ljuhar | |
| 2018/0043382 | A1 | 2/2018 | Li | |
| 2019/0192716 | A1 | 6/2019 | Wang | |
| 2020/0139387 | A1* | 5/2020 | Song | B05B 14/00 |
| 2021/0015956 | A1* | 1/2021 | Lee | A61L 9/14 |
| 2021/0347554 | A1* | 11/2021 | Lee | B05B 7/2424 |

OTHER PUBLICATIONS

Machine Translation of EP-0586913-A2 Description, Espacenet, Mar. 2022, 9 Pages (Year: 2022).*

* cited by examiner

ATOMIZATION DEVICE, AROMA DIFFUSION INSTRUMENT, AND OPERATION METHOD

TECHNICAL FIELD

The present disclosure relates to the technical field of atomization equipment, in particular to an atomization device, an aroma diffusion instrument, and an operation method.

BACKGROUND ART

An existing atomizer uses the siphon principle of a gas pump to firstly suck essential oil from a container to an atomization port through a negative pressure generated by the gas pump at a high speed. This requires a highly closed space, so an atomization space is very small. Impurities of the essential oil easily block a place for atomization. Once blocked, the existing atomizer cannot suck liquid to the atomization port, and the atomization function cannot be enabled normally.

SUMMARY

For the deficiencies in the existing art, the present disclosure provides an atomization device, an aroma diffusion instrument, and an operation method, which solves the technical problems in the existing art that impurities easily block a place for atomization.

According to the embodiments of the present disclosure, an atomization device includes an atomization chamber, a mixing chamber, a container, a suction pump, and a gas pump; the atomization chamber is communicated with the mixing chamber through an atomization port; the suction pump is communicated with the container and the mixing chamber; the suction pump is used for pumping a substance in the container to the mixing chamber or pumping a substance in the mixing chamber back to the container; the gas pump is connected with the mixing chamber to convey high-pressure gas to the mixing chamber; the high-pressure gas is used for atomizing liquid in the mixing chamber through the atomization port; and the atomization chamber is provided with a mist outlet.

The substance in the container is separately directly conveyed into the mixing chamber through the suction pump, instead of sucking essential oil to the atomization port through the siphon action of the gas pump. In this way, an extremely large core region of the atomization device can be made, and the sealing property is not required to be very high. A passage can be made to be extremely fluent to effectively reduce the probability of blockage. Furthermore, the suction pump can complete forward suction (for pumping the substance in the container to the mixing chamber) and backward suction (pumping the substance in the mixing chamber back to the container), and the backward suction can pump the impurities from the atomization port in the mixing chamber to the container, so that the problem of blockage generated at the atomization port of the mixing chamber can be effectively avoided.

Further, a repair cavity is further included; the repair cavity is communicated with the atomization chamber through a first sewage discharge outlet; the repair cavity is communicated with the mixing chamber through a second sewage discharge outlet; the repair cavity is further provided with an opening; a repair piston is hermetically arranged in the opening; gaps are reserved between the repair piston and both of the first sewage discharge outlet and the second sewage discharge outlet; the first sewage discharge outlet and the second sewage discharge outlet are communicated with each other through the gaps so that liquid flowing out of the second sewage discharge outlet can pass through the first sewage discharge outlet and enter the atomization chamber.

Further, a size of the second sewage discharge outlet gradually decreases towards the repair cavity along the mixing chamber.

Further, the mixing chamber and the repair cavity are both located on one side of the atomization chamber, and the repair cavity is located below the mixing chamber.

Further, an air pore nozzle is arranged in the mixing chamber; one end of the air pore nozzle is communicated with the gas pump; and the other end of the air pore nozzle is a reducing end and is opposite to the atomization port.

Further, a first atomization baffle plate opposite to the atomization port is arranged in the atomization chamber; and the first atomization baffle plate is fixedly connected with an oil suction connection pipe.

Further, the atomization chamber is mounted on and communicated with the container; a suction pipe is arranged in the atomization chamber; one end of the suction pipe extends out of the atomization chamber and is communicated with the suction pump; and the other end of the suction pipe extends into the container.

Further, the suction pump is a peristaltic pump; and an inner wall of the atomization chamber below the first sewage discharge outlet is slantways downward.

According to another embodiment of the present disclosure, an aroma diffusion instrument includes the atomization device.

The atomization device is applied to the aroma diffusion instrument to reduce the probability of blockage during atomization of the aroma diffusion instrument.

According to another embodiment of the present disclosure, an operation method of the atomization device includes;

turning on the suction pump to pump liquid in the container to the mixing chamber, the mixing chamber being full of the liquid;

turning on the gas pump to input the high-pressure gas into the mixing chamber, the high-pressure gas turning the liquid in the mixing chamber into high-pressure gas particles through the atomization port, the high-pressure gas particles entering the atomization chamber, and the high-pressure gas particles in the atomization chamber escaping the atomization chamber through the mist outlet;

intermittently turning off the suction pump, and continuing to provide, by the gas pump, high-pressure gas to the mixing chamber to continue to atomize the liquid staying in the mixing chamber;

controlling the suction pump to be operated in a reverse direction to pump the liquid and accumulated impurities in the mixing chamber to the container, continuing to operate the gas pump at the moment to convey the liquid in the mixing chamber to the atomization chamber, and discharging the high-pressure gas particles of the atomization chamber from the mist outlet into the air at the same time; and taking out the repair piston from the opening of the repair cavity, discharging the impurities accumulated in the mixing chamber into the repair cavity through the second sewage discharge outlet, and discharging the impurities from the opening.

Compared with the existing art, the suction pump of the present disclosure firstly pumps the liquid in the container to the mixing chamber, and the gas pump then conveys the high-pressure gas into the mixing chamber, so that the liquid in the mixing chamber is driven by the high-pressure gas to rush to the atomization port at a high speed and is turned into the high-pressure gas particles through the atomization port, and the high-pressure gas particles move towards the atomization chamber at a high speed. In the present disclosure, the suction pump is used to separately convey the liquid in the container into the mixing chamber, which avoids the problem of blockage easily caused by traditional siphon oil suction; furthermore, the suction pump is disposed to reversely pump the impurities in the mixing chamber to the container, so that sticky impurities and other substances easily blocked in the mixing chamber can be pumped out of the mixing chamber to reduce the probability of the blockage of the mixing chamber. The suction pump can also intermittently pump the liquid in the container into the mixing chamber so that the liquid in the mixing chamber can be more efficiently continuously conveyed to the atomization chamber by the high-pressure gas output by the gas pump and the suction pump does not need to work all the time, which reduces the noise and prolongs the service life of the suction pump; meanwhile, the gaps are reserved between the repair piston and both of the first sewage discharge outlet and the second sewage discharge outlet, so that the liquid in the mixing chamber can pass through the gap between the second sewage discharge outlet and the repair piston and enter the atomization chamber through the second sewage discharge outlet to reduce the pressure intensity in the atomization chamber; and moreover, the end of the second sewage discharge outlet facing the repair cavity is the reducing end, which can make the liquid stay in the mixing chamber for longer time for atomization.

In the above drawings: 1: container; 2: atomization chamber; 3: peristaltic pump; 4: gas pump; 5: battery; 6: mist outlet; 7: repair plug; 8: oil suction pipe; 9: gas pump air guide pipe; 10: oil outlet pipe; 11: suction pipe; 12: oil suction connection port; 13: oil suction connection pipe; 141: first atomization baffle plate 142: second atomization baffle plate; 15: bottom oil feed port; 16: oil discharge connection port; 17: scaling rubber ring; 18: first sewage discharge outlet; 19: second sewage discharge outlet; 20: atomization port; 21: air pore nozzle.

DETAILED DESCRIPTION OF THE EMBODIMENTS

The technical solutions of the present disclosure are further described below in detail in combination with accompanying drawings and specific embodiments.

Embodiment I

Figure 1:
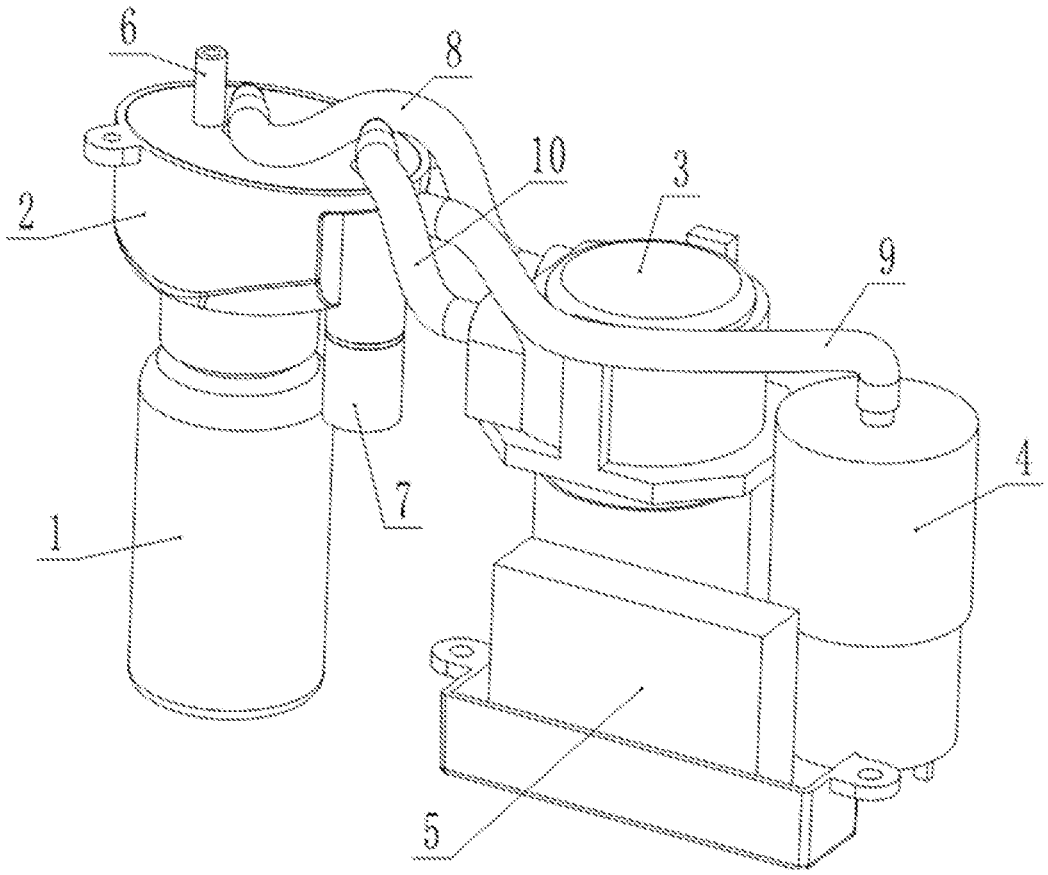
FIG. 1 is a schematic diagram of an entire structure according to the embodiments of the present disclosure.
Figure 2:
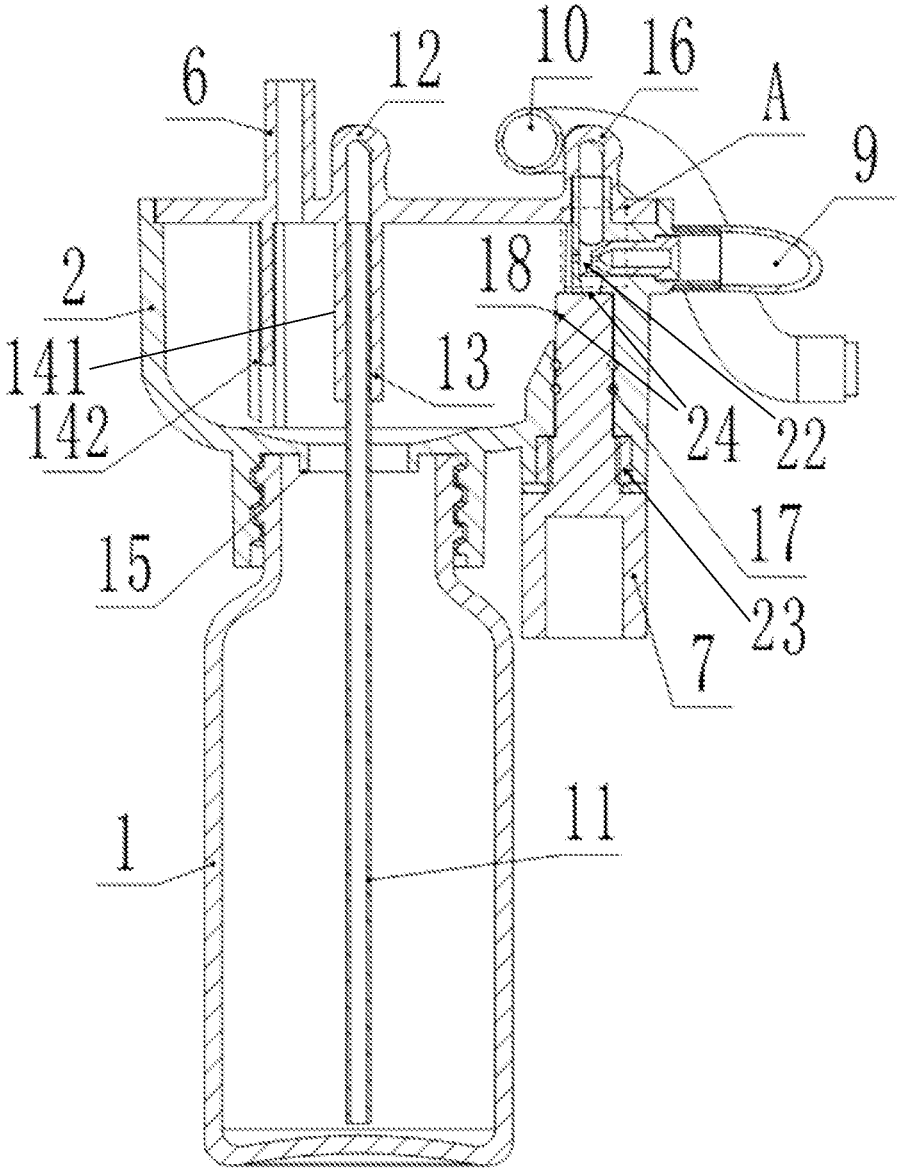
FIG. 2 is a sectional structural diagram of a container and an atomization chamber in the embodiments of the present disclosure.

As shown in FIGS. 1-2, an atomization device includes an atomization chamber 2, a mixing chamber 22, a container 1, a suction pump, a gas pump 4, a battery 5, and a control panel. The atomization chamber 2 is internally hollow and is integrally provided with a downwards protruding connection ring at a bottom; a bottom oil feed port 15 is further formed in the connection ring of the atomization chamber 2; a top of the container 1 extends into the connection ring, and an outer wall of the container 1 is in threaded connection with an inner wall of the connection ring; and the bottom oil feed port 15 of the atomization chamber 2 is communicated with an opening in the top of the container 1. Essential oil liquid or washing liquid can be stored in the container.

A mist outlet 6 and an oil suction connection port 12 adjacent to the mist outlet are formed in the top of the atomization chamber 2; the internal top of the atomization chamber 2 is integrally provided with an oil suction connection pipe 13 communicated with the oil suction connection port 12; the internal top of the atomization chamber 2 is further provided with a first atomization baffle plate 141 and a second atomization baffle plate 142 which extend towards the bottom oil feed port 15 and are parallel to each other: the first atomization baffle plate 141 is fixedly connected with the oil suction connection pipe 13; the mist outlet 6 is located between the second atomization baffle plate 142 and the oil suction connection pipe 13; the first atomization baffle plate 141 is used for enabling the high-speed gas particles output from the atomization port to impact the first atomization baffle plate 141 for secondary decomposition to form finer gas particles; and the second atomization baffle plate 142 is used to prevent the liquid from being poured from the atomization chamber. Specifically, the first atomization baffle plate 141 is located right above the opening (namely the bottom oil feed port 15) of the container; after non-atomized liquid is guided by the first atomization baffle plate 141, most of the liquid can directly flow back into the container; a bottom end of the oil suction connection pipe 13 is vertically downwards and points towards the bottom oil feed port 15; a suction pipe 11 extends into and is fixedly connected to the oil suction connection pipe 13; a bottom end of the suction pipe 11 vertically downwards passes through the bottom oil feed port 15 and extends to the inner bottom of the container 1; and the bottom end of the suction pipe 11 is provided with several filter holes.

The mixing chamber 22 is integrally arranged on one side of the atomization chamber 2; the mixing chamber 22 is communicated with the atomization chamber 2 through an atomization port 20; the top of the mixing chamber and the top 22 of the atomization chamber 2 are located on the same plane; an oil discharge connection port 16 is formed in the top of the mixing chamber 22; an air outlet is formed in a side surface of the mixing chamber 22;

the suction pump is connected with the oil suction connection port 12 through an oil suction pipe 8; the suction pump is connected with the oil discharge connection port 16 through an oil outlet pipe 10; and the gas pump 4 is communicated with an air outlet through a gas pump air guide pipe 9. The suction pump may specifically adopt a peristaltic pump 3 or other pump structures capable of separately pumping the liquid in the container 1 to the mixing chamber; the gas pump 4 is a high-pressure gas pump 4;

the battery 5 provides power for the whole atomization device; and the control panel is used for controlling the operations of the peristaltic pump 3 and the gas pump 4.

Figure 3:
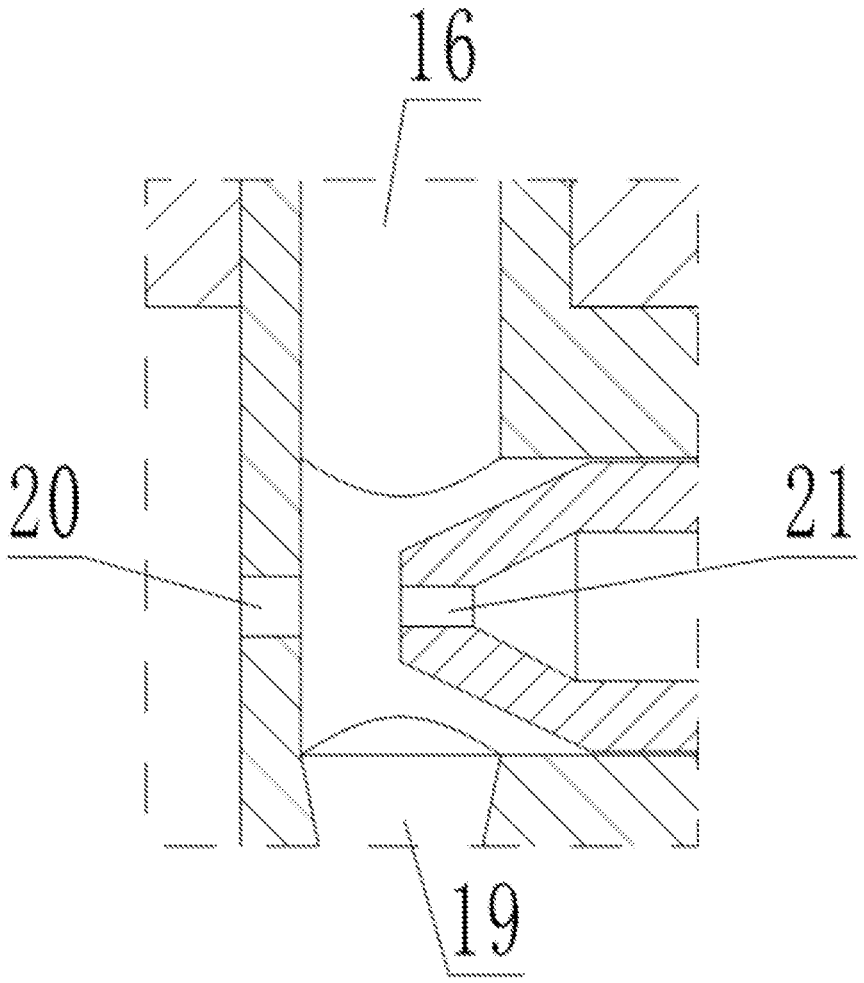
FIG. 3 is an enlarged diagram of Part A in FIG. 2.

As shown in FIGS. 2-3, an air pore nozzle 21 is arranged in the air outlet; an outlet of the air pore nozzle 21 is a reducing end and is opposite to the atomization port 20; an inlet of the air pore nozzle 21 faces a connection between the air outlet and the gas pump air guide pipe 9.

As shown in FIGS. 2-3, one side of the atomization chamber 2 is further integrally provided with a repair cavity 23 located below the mixing chamber 22; a first sewage discharge outlet 18 communicated with the repair cavity 23 is formed in a side wall of the atomization chamber 2; the bottom of the mixing chamber 22 is provided with a second sewage discharge outlet 19 that is communicated to the top of the repair cavity 23 and has a size gradually decreasing from top to bottom (namely an end of the second sewage discharge outlet 19 facing the repair cavity 23 is a reducing end); the repair cavity 23 is further provided with an opening; a repair plug 7 is mounted in the opening; gaps are formed in contacts between the repair plug 7 and both of the first sewage discharge outlet 18 and the second sewage discharge outlet 19, and the first sewage discharge outlet 18 and the second sewage discharge outlet 19 are communicated through the gaps, so that the liquid in the mixing chamber 22 can pass through the gap between the second sewage discharge outlet 19 and the repair plug 7 and enter the atomization chamber through the second sewage discharge outlet 19 to reduce the pressure intensity in the atomization chamber; meanwhile, the end of the second sewage discharge outlet 19 facing the repair cavity 23 is the reducing end, so that the liquid can stay in the mixing chamber 22 for longer time for atomization. The middle part of the repair plug 7 is hermetically mounted in the repair cavity 23 through a sealing rubber ring 17 to prevent liquid leakage and air leakage from the mixing chamber 22 during atomization; the bottom end of the repair plug 7 downwards extends out of the opening of the repair cavity 23; and during repairing, it is easier for an operator to take out the repair plug 7 from the repair cavity 23 from the bottom. The section diagram of the specific structure of the repair plug 7 is as shown in FIG. 2. A rubber pad is arranged at the opening of the repair cavity 23; an end surface of the repair plug 7 connected to the opening of the repair cavity 23 is hermetically connected by the rubber pad, so as to further prevent the liquid leakage and the air leakage of the repair cavity 23 during the atomization. The opening of the repair cavity 23 can also be used to clean the inside of the mixing chamber 22; after washing liquid is put into the container 1, the suction pump and the gas pump are operated to cause the washing liquid in the mixing chamber 22 to be drained from the opening of the repair cavity 23, which can effectively clean the blockage.

Embodiment II

An aroma diffusion instrument includes a housing and the above-mentioned atomization device. The entire atomization device is fixedly mounted in the housing. An end of the above-mentioned mist outlet 6 away from the atomization chamber 2 passes through the housing to output atomized air from the housing.

Embodiment III

By taking a peristaltic pump that is used as a suction pump for example, an operation method of the atomization device includes:

S1, essential oil liquid is stored in the container at first; the peristaltic pump 3 is controlled to be operated by the control panel; the essential oil liquid in the container 1 passes through the filter holes, the suction pipe 11, the oil suction connection port 12, the oil suction pipe 8, the oil discharge pipe 10, and the oil discharge connection port 16 in sequence by pumping power of the peristaltic pump 3 and fully fills the mixing chamber: one part of the essential oil liquid then reaches the atomization port 20; and one part of the essential oil liquid passes through the gap between the second sewage discharge outlet 19 and the repair plug 7 and flows towards an inner wall of the atomization chamber 2 through the second sewage discharge outlet 19, thus flowing back into the container 1. Meanwhile, since the air pore nozzle 21 and the second sewage discharge outlet 19 have the reducing ends, the essential oil liquid rushing into the mixing chamber will neither be immediately discharged from the second sewage discharge outlet 19 into the gap between the second sewage discharge outlet 19 and the repair plug 7, nor be all pushed into the atomization port 20 by the high-pressure gas sprayed by the air pore nozzle 21, which thus causes the essential oil liquid to stay in the mixing chamber for longer time for waiting for atomization. The first sewage discharge outlet 18 and the second sewage discharge outlet 19 are both have the gaps from the repair plug 7. In this way, the liquid can be discharged into the atomization chamber through the gaps to reduce the pressure intensity in the atomization chamber and noise caused by a high pressure.

S2, when the peristaltic pump 3 is operated, the control panel controls the gas pump 4 to be operated, the high-pressure gas rushes into the mixing chamber 22 through the reducing end of the air pore nozzle 21 and turns, through the atomization port 20, the essential oil liquid in the mixing chamber 22 into high-speed gas particles that reach the atomization chamber 2; the high-speed gas particles is atomized into smaller essential oil gas by its collision with the first atomization baffle plate 141 at a high speed: large gas particles are settled down in the container 1; and small gas particles escape out of the atomization chamber 2 from the mist outlet 6. After staying on the inner wall of the atomization chamber 2 for short time, part of the non-atomized essential oil liquid and the large essential oil particles slide down along the inner wall and flow back, through the bottom oil feed port 15, into the container 1 for waiting for atomization again.

S3, after steps S1 and S2 are executed for a period of time, the peristaltic pump 3 is stopped; at the moment, there is one part of essential oil liquid not drained in the mixing chamber for short time; and in this way, under the action of the gas pump 4, the essential oil liquid that is not drained can be drained through the atomization port 20 and is atomized into essential oil gas. Since the peristaltic pump 3 continuously supplies the essential oil liquid into the mixing chamber; after the essential oil liquid in the mixing chamber is emptied, the gas pump 4 continues to supply the high-pressure gas into the mixing chamber to further discharge the essential oil gas in the mixing chamber out of the atomization chamber; and in this way, the essential oil atomization efficiency is improved, and the peristaltic pump 3 does not need to work all the time, which reduces the noise and prolong the service life of the peristaltic pump 3.

S4, after steps S1, S2, and S3 work and are executed for several work cycles, the gas pump 4 continues to be operated, and the control panel controls the peristaltic pump 3 to perform reverse pumping at the same time; one part of the essential oil liquid accumulated in the mixing chamber and particles such as sticky substances that cannot be atomized are reversely pumped back into the container 1 through the peristaltic pump 3; and the high-pressure gas conveyed from the gas pump 4 to the atomization port 20 can continue to turn the other part of essential oil liquid accumulated in the mixing chamber into high-speed gas particles, and the high-speed gas particles are conveyed into the atomization chamber 2. Part of the essential oil liquid and the sticky substances that cannot be atomized are cleaned in time, which greatly reduces the blockage problem of the atomization device.

S5, the control panel controls the peristaltic pump 3 and the gas pump 4 to stop working; the essential oil gas that has been atomized in the atomization chamber 2 will continue to be diffused into the air through the mist outlet 6, so that essential oil molecules around the mist outlet 6 is diffused more uniformly. In addition, the non-atomized essential oil liquid and the large essential oil particles in the atomization chamber 2 flows back into the container 1. Meanwhile, making the peristaltic pump 3 and the gas pump 4 stop working can effectively prolong their service lives.

S6, the durations of steps S1-S5 are adjusted to achieve atomization effects of different kinds of essential oil liquid.

S7, cleaning: the liquid in the container 1 is firstly replaced with washing liquid such as alcohol that can dissolve the essential oil; the repair plug 7 is pulled out from the bottom of the repair cavity to communicate the first sewage discharge outlet 18 and the second sewage discharge outlet 19 to the repair cavity; the peristaltic pump 3 is operated first through the control panel; the washing liquid in the container 1 is driven by the peristaltic pump 3 to pass through the suction pipe 11, the oil suction connection port 12, the oil suction pipe 8, the oil outlet pipe 10, and the oil discharge connection port 16 and then fully fill the mixing chamber to dissolve and dilute the sticky substances accumulated at all positions in the atomization process; the washing liquid flows out through the second sewage discharge outlet 19, the gap between the top of the repair cavity and the top of the repair plug 7, and the first sewage discharge outlet 18 and is drained into the container 1; the other part of the washing liquid can be drained from the second sewage discharge outlet 19 into the repair cavity and flow out of the repair cavity from the opening of the repair cavity; and when the peristaltic pump 3 is operated, the control panel operates the gas pump 4 so that the gas pump 4 outputs gas into the mixing chamber through the reducing end of the air pore nozzle 21 in sequence, and the washing liquid in the mixing chamber cleans the atomization port 20. After cleaning is performed for a period of time, the peristaltic pump 3 is operated reversely to drain all the washing liquid in the mixing chamber, the oil outlet pipe 10, and the suction pipe 11 into the container 1. After cleaning is performed for a period of time, the control panel turns off the peristaltic pump 3 and the gas pump 4, and the repair plug 7 is inserted and hermetically connected into the repair cavity.

At last, it is noted that the above embodiments are merely illustrative of the technical solutions of the present disclosure, and are not intended to be limiting. Although the present disclosure is described in detail with reference to the preferred embodiments, it should be understood that those of ordinary skill in the art can make modifications or equivalent replacements to the technical solutions of the present disclosure without departing from the purpose and scope of the technical solutions of the present disclosure. These modifications and equivalent replacements shall fall within the scope of claims of the present disclosure.

What is claimed is:

1. An atomization device, comprising an atomization chamber, a mixing chamber, a container, a suction pump, and a gas pump, wherein the atomization chamber is communicated with the mixing chamber through an atomization port; the suction pump is communicated with the container and the mixing chamber; the suction pump is used for pumping liquid in the container to the mixing chamber and pumping liquid in the mixing chamber back to the container; the gas pump is connected with the mixing chamber to convey gas to the mixing chamber; the gas is used for atomizing the liquid in the mixing chamber through the atomization port; and the atomization chamber is provided with a mist outlet, wherein a repair plug is detachably connected to g repair cavity that defines an opening at the bottom thereof, and part of the repair plug extending through the opening into the repair cavity, the atomization chamber defines a first sewage discharge outlet corresponding to a side of the repair plug and through the first sewage discharge outlet the repair cavity is communicated with the atomization chamber, the mixing chamber defines a second sewage discharge outlet corresponding to a top of the repair plug and through the second sewage discharge outlet the repair cavity is communicated with the mixing chamber, a first gap is formed between the first sewage discharge outlet and the repair plug and a second gap is formed between the second sewage discharge outlet and the repair plug, through the first gap and the second gap, the first sewage discharge outlet and the second sewage discharge outlet are communicated with each other so that liquid flowing out of the second sewage discharge outlet is capable of passing through the first sewage discharge outlet to enter the atomization chamber, wherein a size of the second sewage discharge outlet gradually decreases towards the repair cavity along the mixing chamber.

2. The atomization device according to claim 1, wherein the mixing chamber and the repair cavity are both located on one side of the atomization chamber, and the repair cavity is located below the mixing chamber.

3. The atomization device according to claim 1, wherein an air pore nozzle is arranged in the mixing chamber; one end of the air pore nozzle is communicated with the gas pump; and the other end of the air pore nozzle is a reducing end and is opposite to the atomization port.

4. The atomization device according to claim 1, wherein a first atomization baffle plate opposite to the atomization port is arranged in the atomization chamber; and the first atomization baffle plate is fixedly connected with an oil suction connection pipe.

5. The atomization device according to claim 1, wherein the atomization chamber is mounted on and communicated with the container; a suction pipe is arranged in the atomization chamber; one end of the suction pipe extends out of the atomization chamber and is communicated with the suction pump; and the other end of the suction pipe extends into the container.

6. The atomization device according to claim 1, wherein the suction pump is a peristaltic pump; and an inner wall of the atomization chamber below the first sewage discharge outlet slants downward.

7. An aroma diffusion instrument, comprising the atomization device according to claim 1.

8. An operation method of the atomization device according to claim 1, comprising:

turning on the suction pump to pump liquid in the container to the mixing chamber, the mixing chamber being full of the liquid;

turning on the gas pump to input the gas into the mixing chamber, the gas turning the liquid in the mixing chamber into gas particles through the atomization port, the gas particles entering the atomization chamber, and the gas particles in the atomization chamber escaping the atomization chamber through the mist outlet;

intermittently turning off the suction pump, and continuing to provide, by the gas pump, gas to the mixing chamber to continue to atomize the liquid staying in the mixing chamber;

controlling the suction pump to be operated in a reverse direction to pump the liquid and accumulated impurities in the mixing chamber to the container, continuing to operate the gas pump at the moment to atomize the liquid in the mixing chamber to the atomization chamber, and discharging the gas particles of the atomization chamber from the mist outlet into the air at the same time;

taking out the repair plug from the opening of the repair cavity, discharging the impurities accumulated in the mixing chamber into the repair cavity through the second sewage discharge outlet, and discharging the impurities from the opening.

* * * * *